US008721472B2

(12) United States Patent
Kuan et al.

(10) Patent No.: US 8,721,472 B2
(45) Date of Patent: May 13, 2014

(54) GOLF CLUB HEAD

(75) Inventors: Jimmy Kuan, West Covina, CA (US); Christopher R. Cooper, Orange, CA (US); Michael Sandoval, La Palma, CA (US); Adam K. Sheldon, Long Beach, CA (US); Edward Mendoza, Costa Mesa, CA (US)

(73) Assignee: SRI Sports Limited, Hyogo (JP)

( * ) Notice: Subject to any disclaimer, the term of this patent is extended or adjusted under 35 U.S.C. 154(b) by 1338 days.

(21) Appl. No.: 11/709,780

(22) Filed: Feb. 23, 2007

(65) Prior Publication Data

US 2007/0207875 A1 Sep. 6, 2007

Related U.S. Application Data

(60) Provisional application No. 60/778,375, filed on Mar. 3, 2006.

(51) Int. Cl.
*A63B 53/00* (2006.01)

(52) U.S. Cl.
USPC ..... 473/341; 473/340; 473/338

(58) Field of Classification Search
USPC ..... 473/334, 335–339, 341
See application file for complete search history.

(56) References Cited

U.S. PATENT DOCUMENTS

| | | | | | |
|---|---|---|---|---|---|
| 2,517,245 | A | * | 8/1950 | Scott | 473/339 |
| 3,516,674 | A | | 6/1970 | Scarborough | 273/169 |
| 4,043,563 | A | * | 8/1977 | Churchward | 473/338 |
| 4,085,934 | A | * | 4/1978 | Churchward | 473/338 |
| 4,423,874 | A | * | 1/1984 | Stuff, Jr. | 473/338 |
| 4,655,459 | A | | 4/1987 | Antonious | 273/171 |
| 4,962,932 | A | | 10/1990 | Anderson | 273/171 |
| 4,979,744 | A | * | 12/1990 | Alcala | 473/341 |
| 5,246,227 | A | | 9/1993 | Sun et al. | 273/78 |
| 5,253,869 | A | | 10/1993 | Dingle et al. | 273/80.1 |
| 5,385,348 | A | | 1/1995 | Wargo | 273/171 |
| 5,388,827 | A | | 2/1995 | Reynolds, Jr. | 273/80.1 |
| 5,518,243 | A | | 5/1996 | Redman | 473/334 |
| 5,533,725 | A | | 7/1996 | Reynolds, Jr. | 473/307 |
| 5,571,053 | A | | 11/1996 | Lane | 473/336 |
| 5,839,974 | A | | 11/1998 | McAllister | 473/337 |
| 5,871,407 | A | * | 2/1999 | Tseng | 473/328 |

(Continued)

OTHER PUBLICATIONS

"Big Bertha Fusion FT-3 Driver," Callaway Golf, Microsoft Internet Explorer, wvvw.callawaygolf.com, Feb. 23, 2007.

(Continued)

*Primary Examiner* — Gene Kim
*Assistant Examiner* — Matthew B Stanczak
(74) *Attorney, Agent, or Firm* — Steptoe & Johnson LLP

(57) ABSTRACT

An adjustable golf club incorporates instructions into the golf club, and more particularly, in connection with the club head. More specifically, encoded information is visibly provided on the club head, the encoded information relating to the performance of the club head. In addition to the encoded information, a decoder or device for interpreting the encoded performance information is also provided on the club head. The encoded information, in conjunction with the decoder, allows the golfer to easily adjust his or her club head based on playing conditions or his or her swing. Typically, the encoded information relates to a weight of the club head, and may be used to vary the weight of the club head. A method of configuring a putter-type golf club head adaptable to a plurality of configurations is described, as well as a kit for selectively configuring components of a golf club head.

18 Claims, 9 Drawing Sheets

(56) References Cited

U.S. PATENT DOCUMENTS

| | | | | |
|---|---|---|---|---|
| 5,921,871 | A | 7/1999 | Fisher | 473/329 |
| 6,019,686 | A | 2/2000 | Gray | 473/313 |
| 6,089,994 | A * | 7/2000 | Sun | 473/338 |
| 6,348,014 | B1 | 2/2002 | Chiu | 473/337 |
| 6,394,910 | B1 | 5/2002 | McCarthy | 473/251 |
| 6,458,044 | B1 | 10/2002 | Vincent et al. | 473/334 |
| 6,511,387 | B2 * | 1/2003 | Grieb | 473/330 |
| 6,527,649 | B1 | 3/2003 | Neher et al. | 473/248 |
| 6,773,360 | B2 | 8/2004 | Willett et al. | 473/334 |
| 6,796,911 | B2 | 9/2004 | Grace | 473/251 |
| 6,860,817 | B2 * | 3/2005 | Middleton | 473/231 |
| 6,896,625 | B2 | 5/2005 | Grace | 473/251 |
| D510,395 | S * | 10/2005 | Miraflor et al. | D21/759 |
| 6,974,394 | B1 | 12/2005 | Tang et al. | 473/335 |
| D574,050 | S * | 7/2008 | Jones et al. | D21/759 |
| D574,915 | S * | 8/2008 | Jones et al. | D21/759 |
| 7,604,548 | B2 * | 10/2009 | Cole | 473/324 |
| 7,744,485 | B2 * | 6/2010 | Jones et al. | 473/324 |
| 7,887,432 | B2 * | 2/2011 | Jones et al. | 473/324 |
| 2004/0138003 | A1 | 7/2004 | Grace | 473/334 |
| 2004/0242343 | A1 | 12/2004 | Chao et al. | 473/334 |
| 2005/0009627 | A1 | 1/2005 | Willett et al. | 473/338 |
| 2005/0026716 | A1 * | 2/2005 | Wahl et al. | 473/334 |
| 2005/0130763 | A1 | 6/2005 | Johnson | 473/340 |
| 2005/0181884 | A1 | 8/2005 | Beach et al. | 473/131 |
| 2005/0209021 | A1 | 9/2005 | Hoffman et al. | 473/334 |
| 2005/0221911 | A1 | 10/2005 | Beach et al. | 473/338 |
| 2005/0227783 | A1 | 10/2005 | Olsavsky et al. | 473/340 |
| 2006/0240907 | A1 * | 10/2006 | Latiri | 473/334 |

OTHER PUBLICATIONS

Ken's Metallica, Japanese Universal Catalogue 2003, p. 354, Feb. 23, 2007.

"Wedges CG11™ Wedges;" Cleveland Golf, Microsoft Internet Explorer, www.clevelandgolf.com, Feb. 23, 2007.

* cited by examiner

GOLF CLUB HEAD

This application claims priority to U.S. provisional patent application Ser. No. 60/778,375, filed Mar. 3, 2006, which application is incorporated herein by reference in its entirety.

BACKGROUND

For years, golf club manufacturers have placed limited information on the golf club head relating to golf club specifications. For example, most golf clubs generally indicate the loft of the club face or the size of the head. Due to advancements in technology, additional performance characteristics have become important to the golfer when purchasing or using golf clubs. However, due to the limited space on the club head, indicia corresponding to such additional performance characteristics could not be conveniently displayed for the golfer's reference.

To remedy this shortcoming, manufacturers began using encoded information, such as small colored dots, to embody particular performance characteristics. Such encoded information is explained in a manual or instruction book supplied with the club head. While this approach allows manufacturers to provide the user with detailed information about their golf club, several problems are associated therewith.

For example, golf clubs having adjustable features generally display specific encoded information, symbolized, e.g., by colored dots, that indicates particular performance characteristics associated with a club's given configuration. To decode this information, the user must consult the manual or instruction book provided with the club. If the manual or instruction book is lost or damaged or is unavailable at the golf course, the golfer could lose confidence in the club, ultimately affecting the quality of his or her game.

SUMMARY OF THE INVENTION

A need exists for a golf club that incorporates encoded information thereon and an information decoder on the golf club for the encoded information. The present invention in its various embodiments fulfills this need and others.

In one exemplary embodiment of the present invention, a golf club head comprises a cipher or encoded information, wherein the cipher relates to performance characteristics of the club head. In addition to the cipher, means for interpreting the encoded performance characteristics of the cipher are also provided with the club head, e.g. a decoder. The cipher, in conjunction with the means for interpreting the encoded performance characteristics, allows the golfer to adjust his or her club head based on the playing conditions or his or her swing.

In another aspect of the present invention, a kit for a golf club head having reconfigurable features is disclosed. The kit includes a club head having a plurality of reconfigurable elements with information encoded thereon and an information decoder associated with the club head. A tool is included that allows the golfer to adjust the reconfigurable features.

These and other features, aspects, and advantages of the various embodiments will become apparent after consideration of the ensuing description, the accompanying drawings, and the appended claims.

BRIEF DESCRIPTION OF THE DRAWINGS

The present invention will become more fully understood from the detailed description given below and the accompanying drawings which are given by way of illustration only, and thus do not limit the present invention, and wherein.

For purposes of illustration, these figures are not necessarily drawn to scale. Like components in the figures are designated by like reference numerals.

DETAILED DESCRIPTION

Throughout the following description, specific details are recited to provide a more thorough understanding of the various embodiments of the invention. However, the invention may be practiced without these particulars. In other instances, well known elements have not been shown or described to avoid unnecessarily obscuring the invention. Accordingly, the description and drawings are to be regarded in an illustrative, rather than a restrictive sense.

At the outset, it should be appreciated that aspects of the present invention may be utilized in connection with a driver-type golf club, an iron-type golf club, or a putter-type golf club. For purposes of explanation, the following description will address characteristic features of a club head 10 as they may relate to certain putter-type golf clubs. More specifically, a mallet type putter head is described in connection with FIGS. 1 through 4 and a blade type putter head is described in connection with FIGS. 5 through 7.

Figure 1:
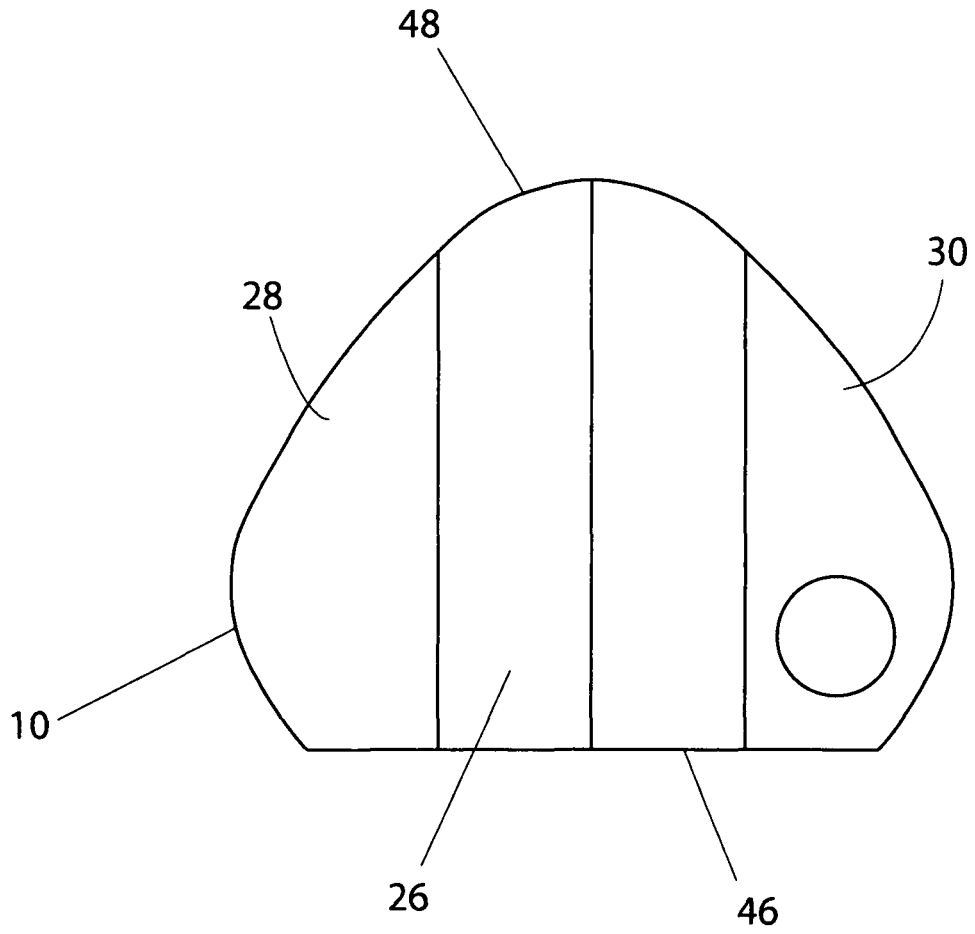
FIG. 1 is a top plan view of a club head according to a preferred embodiment of the present invention.
Figure 2:
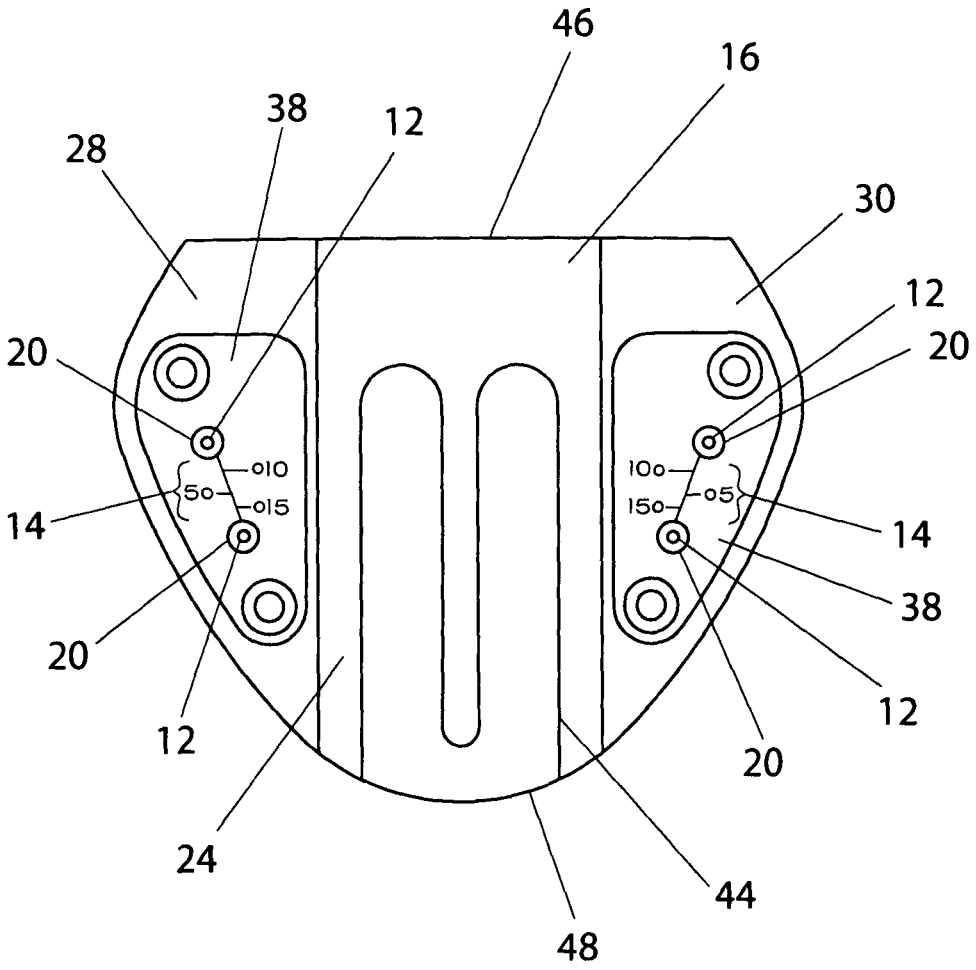
FIG. 2 is a bottom plan view of the club head of FIG. 1.
Figure 3:
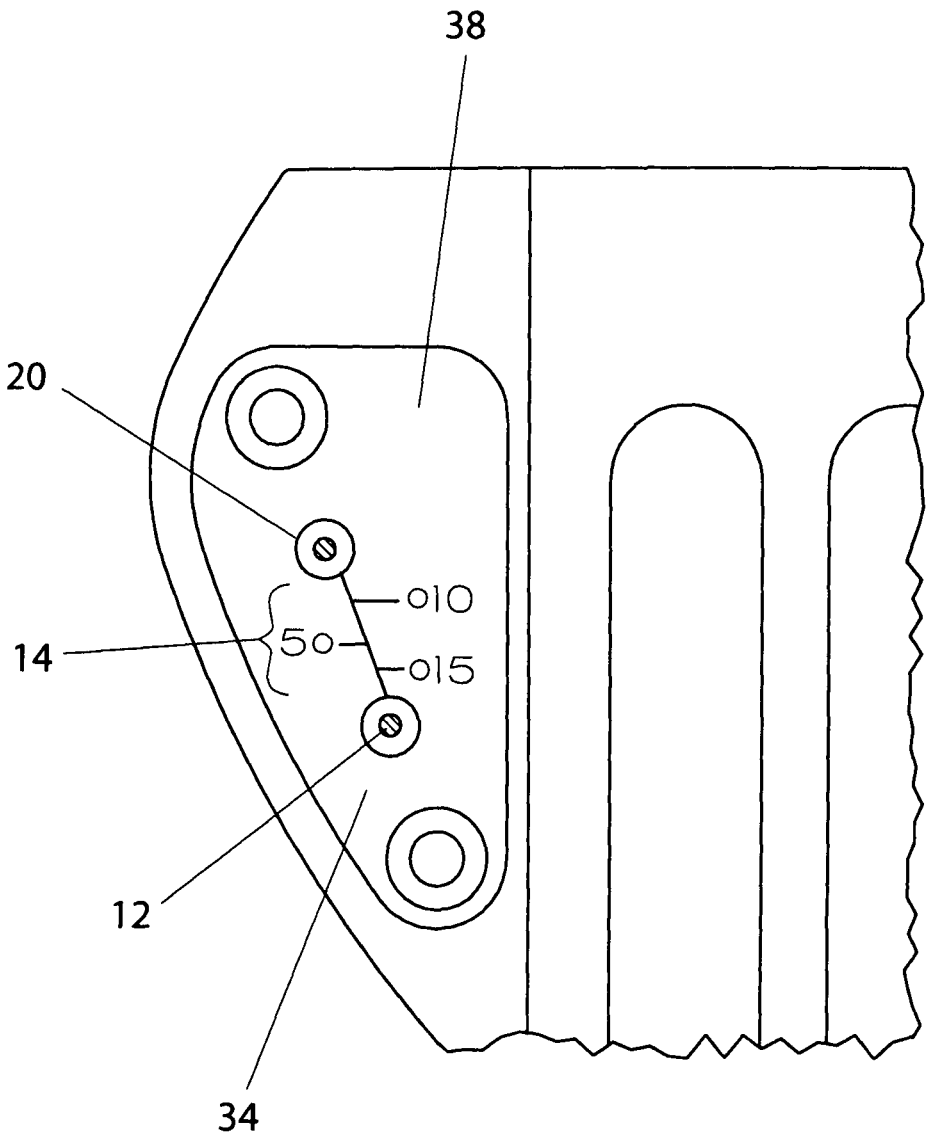
FIG. 3 is a detailed view of a portion of the club head of FIG. 2.

Referring to FIGS. 2 and 3, one embodiment of the invention may include a golf club head 10 having encoded information or a cipher 12 thereon, the cipher 12 being associated with performance characteristics of the club head 10. The cipher 12, perceivable from the exterior of the club head 10, may be any type of indicating medium such as a color, mark, or alphanumeric indicia. For example, the cipher 12 may be a color display, whereby each performance characteristic or set of performance characteristics of the club head 10 is associated with a particular color or color combination. In order to acquire the specific performance characteristic associated with the cipher 12, means for interpreting the cipher, such as a decoder 14, may be provided on the club head. In one embodiment of the invention, the decoder 14 may be more specifically characterized as decoding indicia on an exposed surface 38 of a cover or plate 34. The decoding indicia allow the golfer to select from a plurality of available club head configuration options.

Figure 4:
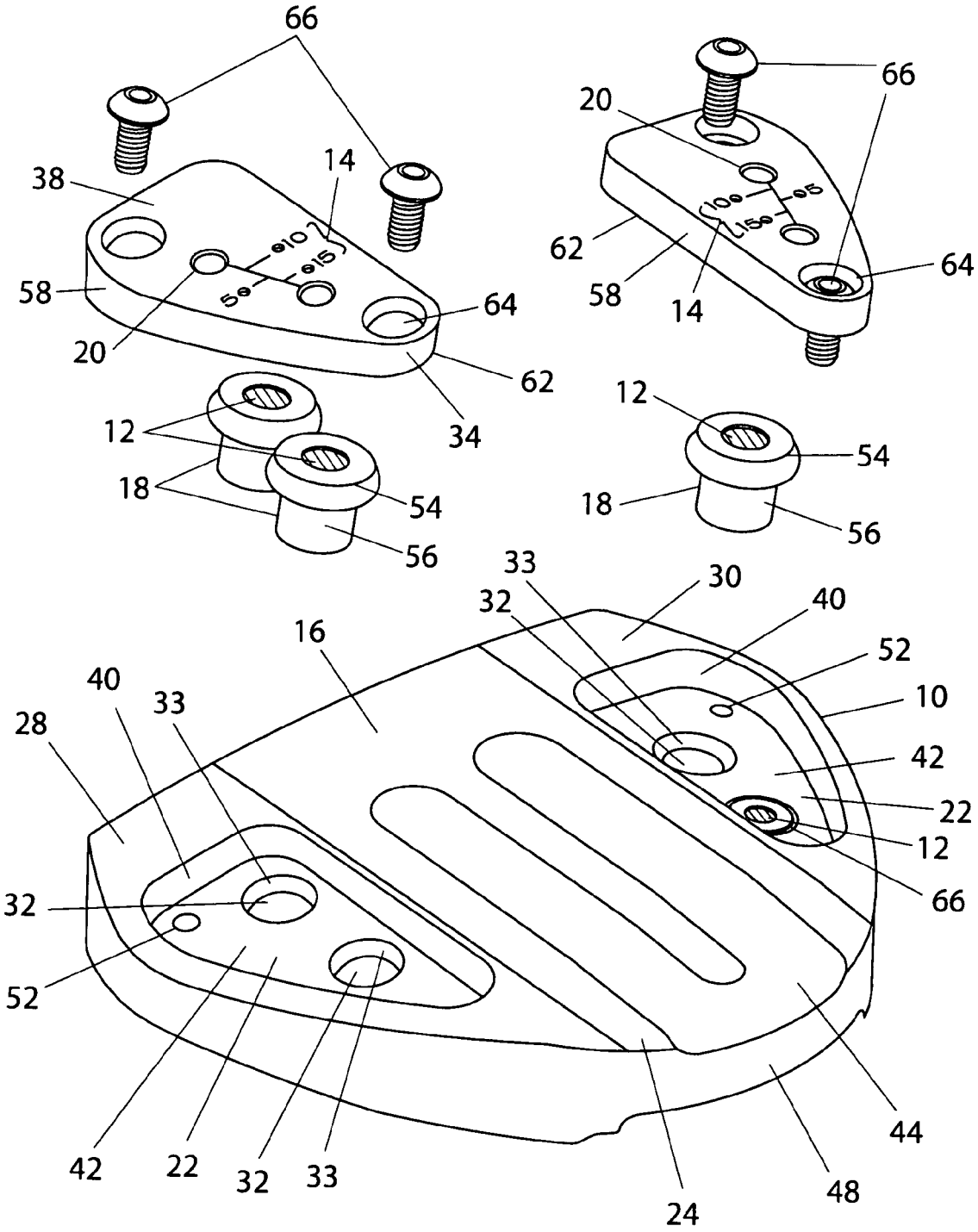
FIG. 4 is an exploded view of the club head of FIG. 2 taken from a bottom perspective.

As apparent from FIG. 2, the golf club head 10 may be additionally characterized by a body 16, having a striking face 46 thereon. At least one element 18, with the cipher 12 thereon, may be coupled to the body 16 of the club head, as shown in FIG. 4. The cover 34 may retain the element 18 within the body 16 and may include means for observing the cipher on the element 18, e.g., an aperture 20.

Referring to FIG. 4, the body 16 of the club head 10 may be further characterized by a toe region 28 and an opposing heel region 30, with at least one recess 22 formed in both the toe region 28 and the heel region 30. At least one opening 32 may be disposed within the recess 22 for housing the element 18, which may be at least partially press fit into the opening 32. The body 16 may further include a sole 24 and an upper surface 26 (FIG. 1) opposite the sole 24, such that the element 18 may lie between the sole 24 and the upper surface 26 of the body 16, when disposed in the opening 32.

The recess 22 in the sole 24 of the club head 10 may be delimited by a sidewall 40, terminating in a floor surface 42. This imparts a characteristic shape to the recess 22, which may be varied according to the design details of the club head body 16. In addition, the sole 24 of the club head 10 may include an intermediate portion 44, substantially corresponding to a longitudinal axis of the club head 10 between the striking face 46 and a rear portion 48 opposing the striking face 46. The intermediate portion 44 may physically separate the toe region 28 from the heel region 30, and thus physically separate the recesses 22 in each region. Although the intermediate portion 44 is shown to include a grooved surface in an exemplary embodiment of the invention, it may alternatively comprise a smooth or otherwise non-grooved surface.

According to various design considerations, the recess 22 may encompass a substantial area of the sole 24 on each side of the intermediate portion 44 or may alternatively be minimized. For example, the recess 22 may or may not be shaped to correspond to that of the peripheral surface shape of the club head 10.

The at least one opening 32 formed in the floor 42 of each recess 22 may thus provide a further depth to a selected portion of the recess 22. Plural openings 32 may be positioned such that they align with a longitudinal axis of the putter head 10 or may be offset from each other. Additionally, openings 32 may be positioned immediately adjacent each other, evenly spaced within the recess 22, or randomly positioned according to a particular configuration of club head 10. The opening 32 may include a substantially smooth or rough inner sidewall surface 33 and may or may not terminate within the club head 10.

The element 18 may fit into the opening 32 with a clearance or interference fit and may be readily interchangeable with other such elements of different mass. In addition, the element 18 may have a peripheral flange 54 and a shank member 56, as shown in FIG. 4. Although the element 18 is shown in the figures as generally cylindrical, it will be appreciated that element 18 may have virtually any shape.

The flange 54 may rest on the floor surface 42 of the recess 22, thereby enabling the shank member 56 of the element 18 to be easily inserted into and withdrawn from the opening 32. Further, the flange 54 may be of a size and thickness to be easily grasped for removal of the element 18 from the opening 32. The cipher 12 may be formed e.g., at the flange end 54 of the element 18 and may consist of a color, mark, alphanumeric indicia, or the like, corresponding to a particular attribute, configuration, or feature of the club head.

In one embodiment of the invention, a plurality of interchangeable elements 18 having the same or different discrete masses may be provided as a set. The cipher 12 may identify the mass of the element 18, wherein a different cipher 12 is used to represent each different discrete mass. Thus, by selectively coupling at least one element 18 to the club head 10, a corresponding mass is added to the club head 10 to define a final desired weight thereof.

For example, the mass of element 18 may vary from about 1 gram to about 50 grams. The set of elements 18 may include at least three elements weighing 5 grams, 10 grams, and 15 grams each. Those skilled in the art will appreciate that a set of elements 18 may comprise any number of elements and that the mass of any given element 18 within a set may or may not be unique. In use, one or more elements 18 selected from the set may be inserted into one or more predetermined openings 32 in order to provide a club head having a desired final weight and mass distribution. Once inserted into the appropriate opening 32, the cover 34 may secure the element 18 in the opening 32, while at the same time providing means for observing the cipher on the element 18, e.g., via a window or aperture 20.

The cover 34 may comprise a plate or other similar structure having an external sidewall 58, an exposed outer surface 38, and an inner surface 62 opposing the outer surface 38. The height of the external sidewall 58 may be substantially similar to the height of an internal sidewall 40 of the recess 22 if appearance and/or functionality considerations so require. The recess 22 preferably receives the cover 34 with a clearance fit to facilitate removal and replacement of the cover.

Referring to FIG. 4, at least one fastening hole 52 may be formed in the floor 42 of the recess 22 such that the fastening hole 52 does not interfere with the shape or function of the openings 32. For example, one fastening hole 52 (not shown) may be positioned within the recess 22 adjacent the striking face 46 of the putter head 10 and a second fastening hole 52 may be positioned within the recess 22 adjacent the rear portion 48 of the club head 10. Typically, the fastening holes 52 may be in proximity to the side wall 40 of the recess 22. It will be appreciated that the fastening holes 52 may be threaded or have other suitable structures for receiving a fastening element.

The cover 34 may include through-holes 64 aligned with the fastening holes 52 of the recess 22, along with the aperture or window 20 for viewing the elements 18. The window 20 may be formed in the cover 34 such that the window 20 may substantially align with the openings 32 formed in the recess 22. Accordingly, the cover 34 may overlay the elements 18 inserted into the openings 32 such that the cipher or encoded information 12 on the elements 18 may be visible through the window 20 of the cover 34. The window 20 may be any suitable shape for viewing the cipher 12 encoded on elements 18. For example, the window 20 may be shaped as a longitudinal slot, a circle, an oval, a rectangle, or any other suitable geometric shape.

In order to secure the cover 34 to the club head 10, fasteners 66 may be provided. The fasteners 66 engage with the fastening holes 52 of the recess 22 via the through-holes 64 of the cover 34. The fasteners 66 may be press fit, threaded, or otherwise configured for fastening the cover 34 to the club head 10.

A desired final weight of the club head 10 may be obtained by inserting at least one selected element 18 into the appropriate opening(s) 32 of the recess 22. The cover 34 may assist in coupling elements 18 to head 10 while providing means for observing the cipher or encoded information via aperture 20.

In order to visually determine the weight associated with selected elements 18 coupled to the head 10, reference may be made to the decoder 14 provided on the outer surface 38 of the cover 34. More specifically, the decoder 14 may be positioned in proximity to the window 20 or aperture of the cover 34. In this manner, the cipher 12 encoded on the elements 18 may be immediately interpreted using the decoder 14.

For example, the cipher 12 encoded on elements 18 may include color red for an element having a mass of 5 grams, color white for an element having a mass of 10 grams, and color blue for an element having a mass of 15 grams. Once elements 18 are configured within the club head, the weight and the mass distribution of the club head may readily be determined by reference to the decoder 14, which specifies the relationship between the weights and the colors. For ease of reference, the decoder 14 may be positioned in close proximity to the window 20.

While the cipher and means for interpreting said cipher are described in connection with the sole 24 of the club head 10, it will be appreciated that these features may likewise be applied to other parts of the club head 10. For example, such features may be implemented on the upper surface 26 of the club head 10 or any other suitable location.

Figure 5:
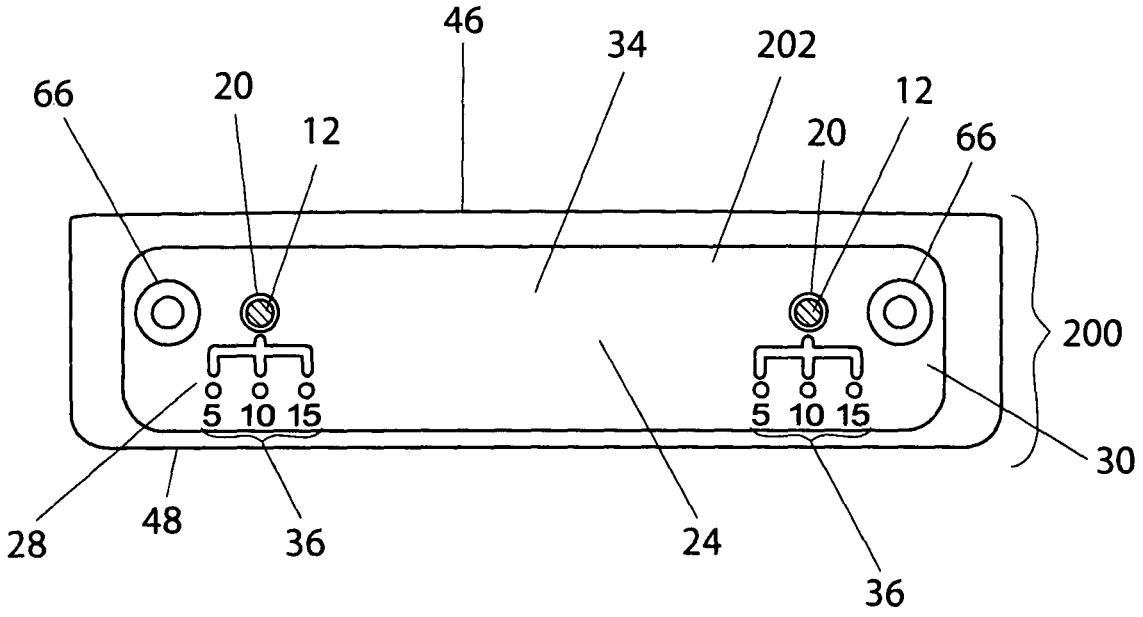
FIG. 5 is a bottom plan view of a blade type club head according to an alternative embodiment of the present invention.
Figure 6:
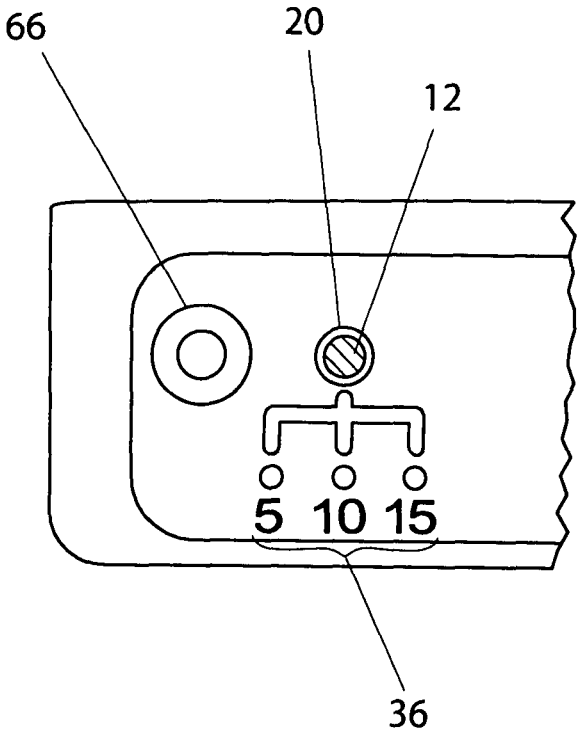
FIG. 6 is a detailed view of a portion of the club head of FIG. 5.

Referring now to FIGS. 5 and 6, another implementation of the golf club head according to the present invention is described and illustrated as it may be applied to a blade type putter head 200. Many aspects of this embodiment are similar to those described above, and the following description will assist in the understanding that the principles of the invention may be applied to putters of various shapes such as the blade type putter 200.

Typically, the blade type putter head 200 may include a body 202 of a substantially rectangular shape. This characteristic head shape may have less volume than that of a mallet type putter head 10. In the following description, relevant parts of the blade type putter 200 corresponding to those of the mallet type putter 10 will be identified with like reference numerals.

In one embodiment of the invention, the blade type putter head 200 may include the striking face 46 and the rear portion 48 opposing the striking face 46, the sole 24 and the upper surface (not shown) opposing the sole 24. Further, the sole of the club head 200 may also include the plate or cover portion 34, having windows or apertures 20 thereon for viewing the cipher 12 encoded on the elements 18 and fasteners 66 for demountably securing the cover or plate 34 to the club head. The decoder 36 may be formed on a surface of the cover 34 in the same manner as described above.

Figure 7:
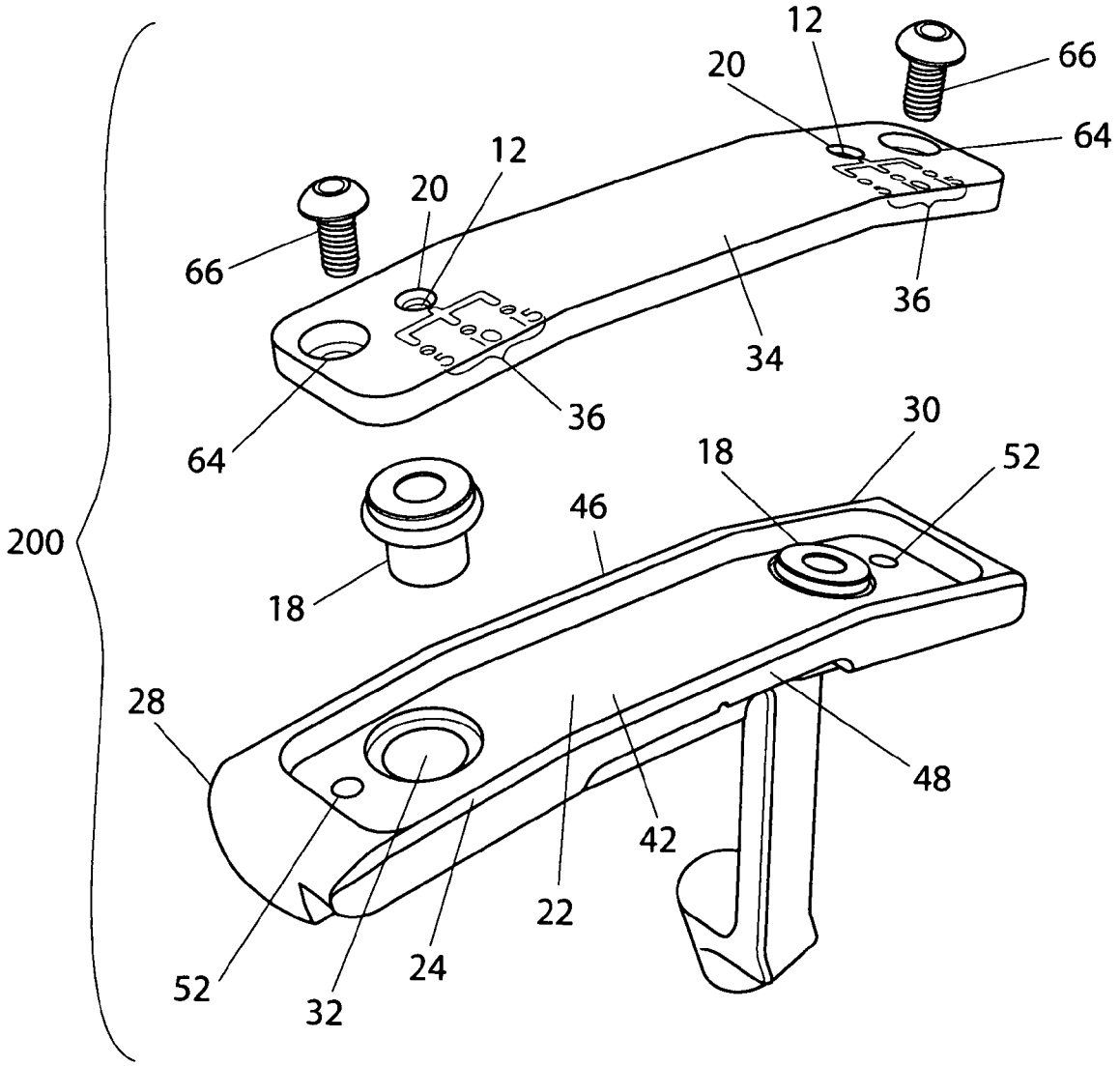
FIG. 7 is an exploded view of the club head of FIG. 5 taken from a bottom perspective.

Referring to FIG. 7, the blade type putter 200 may also include the recess 22, the openings 32, the fastening holes 52 formed in the floor surface 42 of the recess 22, and the encoded elements 18, which may be inserted into the openings 32. The blade type putter head 200 may include at least one recess 22, which may extend from the toe region 28 to the heel region 30 of the club head 200. There may be two openings 32 in the recess 22, one in the toe region 28 and one in the heel region 30 of the club head 200. A single opening 32 may also be contemplated.

For the blade type club head 200, the mass of each element 18 may vary from e.g. about 1 grams to about 50 grams, and a set of elements 18 having the same or different masses may be preferred. For example, a set of elements 18 may include at least three elements weighing 5 grams, 10 grams, and 15 grams each. Those skilled in the art will appreciate that a set of elements 18 may comprise any number of elements and that two or more elements within a set may have the same mass. In use, elements may be interchangeable such that any one selected element 18 may be inserted into a predetermined one of the openings 32 in order to provide a club head of a desired final weight and mass distribution. Once the selected elements 18 are inserted into their respective openings 32, the cover 34 may retain the elements 18 in place, while at the same time providing at least one window or aperture 20 for observing the cipher 12 encoded on the elements 18. It should be appreciated that elements 18 may be configured in the club head such that at least one opening 32 remains unfilled.

As with the mallet-type putter-head, the cipher 12 encoded on the elements 18 may include color red for an element having a mass of 5 grams, color white for an element having a mass of 10 grams, and color blue for an element having a mass of 15 grams. Once elements 18 are configured within the club head, the weight and the mass distribution of the club head may readily be determined by reference to the decoder 36, which specifies the relationship between the weights and the colors. For ease of reference, the decoder 36 may be positioned in close proximity to the window 20.

Although the cipher 12 and the means for interpreting the cipher (i.e. decoder 14) have been addressed in connection with the mass properties of various club heads, it will be appreciated that the cipher 12 and decoding features could be implemented to indicate variation in any number of club characteristics, such as a lie angle, loft angle, alignment indicia and others.

Figure 8:
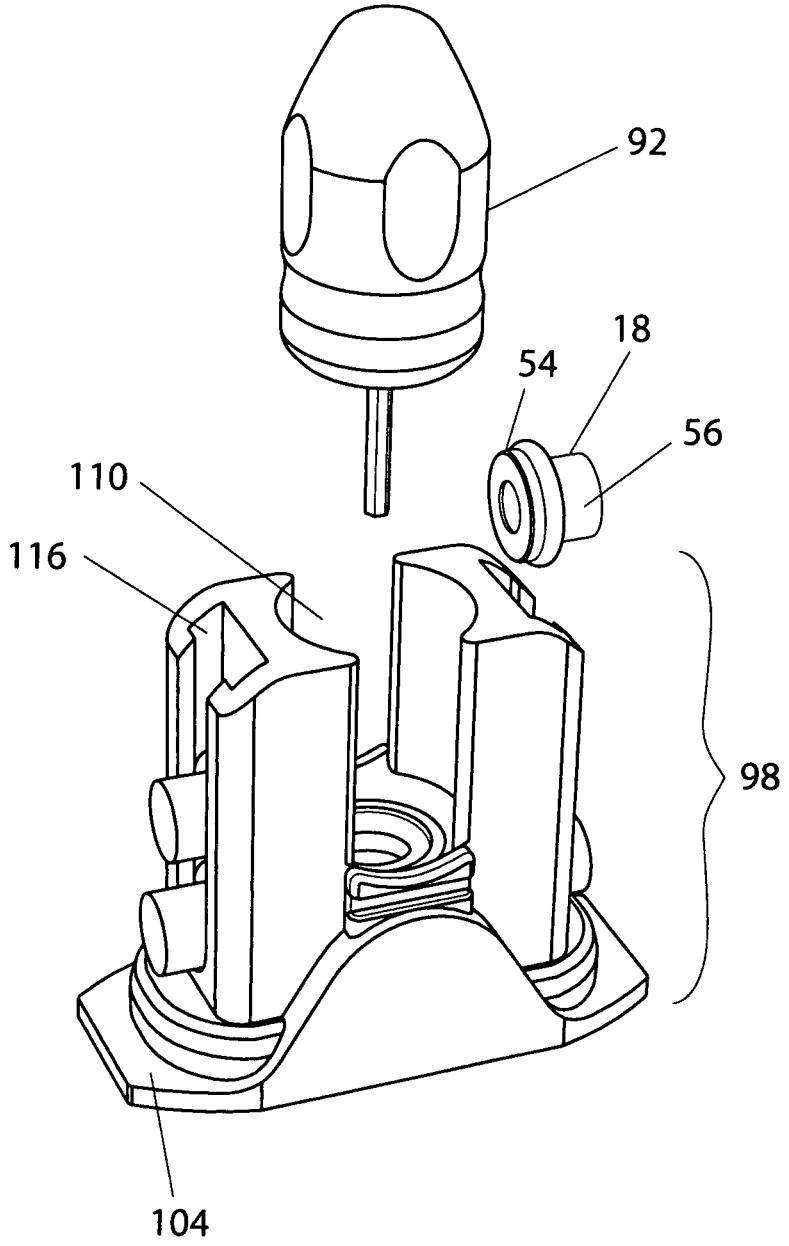
FIG. 8 is an exploded view of the element and tool housing with no cover.
Figure 9:
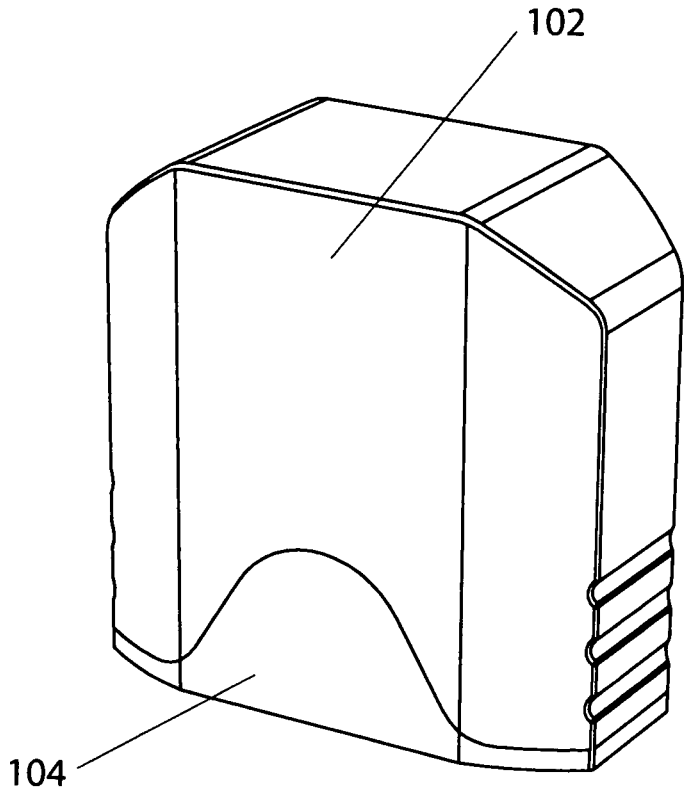
FIG. 9 is a perspective view of the element and tool housing with cover.

A tool kit for reconfiguring the golf club head, as described above, may be provided. The tool kit may comprise a plurality of elements 18 with information encoded thereon, and a tool 92 for reconfiguring the elements 18 in the golf club head 10. In one embodiment of the invention, a housing 98, having a cover 102 and a base 104, may be provided for storing the elements 18 and the tool 92. Referring to FIG. 8, the housing 98 may include at least one vertical slot 116 to accommodate the plurality of elements 18 and a central bore 110 for receiving the tool 92. Elements 18 may be retained in the housing by slideably engaging the vertical slot 116. A protective cover 102 may enclose at least a portion of said housing 98 and may press fit onto the base 104, as shown in FIG. 9.

The above-described embodiments of the golf club head are given only as examples. Therefore, the scope of the invention should be determined not by the illustrations given, but by the appended claims and their equivalents.

What is claimed is:

1. A mutable golf club head comprising:

a body;

at least one weighting element demountably coupled to the body;

discrete information encoded on each weighting element, the encoded discrete information corresponding to the mass of each so-encoded weighting element and visible when the at least one weighting element is coupled to the body;

a plate portion demountably coupled to the body; and decoding indicia located on an exposed surface of the plate portion for decoding the encoded discrete information encoded on each weighting element, the decoding indicia visible in its entirety when the plate portion is coupled to the body, the plate portion further including means for viewing the encoded discrete information on the at least one weighting element coupled to the body.

2. The mutable golf club head of claim 1, wherein the body comprises a sole and an upper surface opposite the sole, and the at least one weighting element is between the sole and the upper surface of the body.

3. The mutable golf club head of claim 1, further comprising at least one recess formed in the body.

4. The mutable golf club head of claim 3, wherein the body comprises opposed toe and heel regions, with at least one recess in the toe region and at least one recess in the heel region.

5. The mutable golf club head of claim 3, wherein at least one opening is within the at least one recess and the weighting element is press fitted at least partially into the opening.

6. The mutable golf club head of claim 5, wherein the plate portion retains the at least one weighting element in the opening.

7. The mutable golf club head of claim 3, wherein the plate portion is seated in the recess.

8. The mutable golf club head of claim 1, comprising a plurality of weighting elements having the same or different discrete masses ranging from 1 to 50 grams.

9. The mutable golf club head of claim 1, wherein the means for viewing the encoded discrete information includes a window for observing a portion of the weighting element coupled to the body.

10. The mutable golf club head of claim 1, wherein the weighting element is interchangeable with other weighting elements of varying masses.

11. The mutable golf club head of claim 1, comprising a plurality of weighting elements each bearing discrete encoded information in the form of a color corresponding to the mass of the weighting element bearing that color.

12. The mutable golf club head of claim 11 wherein the decoding indicia is a chart of a plurality of colors and the masses of weighting elements uniquely corresponding to each color.

13. A kit for a golf club head comprising:

a mutable golf club head comprising:

(a) a plurality of weighting elements for reconfiguring such a golf club head, each such element having discrete encoded information thereon corresponding to its mass;

(b) a plate portion demountably coupled to the mutable golf club head;

(c) decoding indicia for decoding the discrete encoded information located on an exposed surface of the plate portion, the decoding indicia visible in its entirety when the plate portion is coupled to the mutable golf club head, the plate portion further including means for viewing the discrete encoded information; and (d) a tool for rearranging the weighting elements in the golf club head.

14. The kit of claim 13, further comprising instructions for selecting and positioning the weighting elements about the club head.

15. A mutable golf club head comprising:

a body;

at least one weighting element demountably coupled at least partially within the body;

discrete information encoded on each weighting element, the encoded discrete information corresponding to the mass of each so-encoded weighting element and visible when the at least one weighting element is at least partially within the body; and decoding indicia for decoding the encoded discrete information, the decoding indicia located on a surface of a plate portion demountably coupled to the body, the decoding indicia being visible in its entirety when the plate portion is coupled to the body, the plate portion further including an opening for viewing the encoded discrete information on a weighting element at least partially within the body.

16. The mutable golf club head of claim 15, wherein the body and plate portion fully enclose the weighting element, only the encoded discrete information thereon being visible through the opening in the plate portion.

17. The golf club head of claim 15, comprising a plurality of weighting elements each bearing discrete encoded information only in the form of a color corresponding to the mass of the weighting element bearing that color.

18. The mutable golf club head of claim 17 wherein the decoding indicia is a chart of a plurality of colors and the masses of weighting elements uniquely corresponding to each color.

* * * * *